US005158284A

United States Patent [19]

Vogl

[11] Patent Number: 5,158,284

[45] Date of Patent: Oct. 27, 1992

[54] GAME BALL CONSTRUCTION

[76] Inventor: Craig J. Vogl, R.D. #3 Ponderosa Rd., Kent, N.Y. 10512

[21] Appl. No.: 791,354

[22] Filed: Nov. 14, 1991

[51] Int. Cl.[5] ..... A63B 39/08

[52] U.S. Cl. ..... 273/60 B; 273/DIG. 20; 273/58 K

[58] Field of Search ..... 273/58 D, 58 R, 58 H, 273/58 K, 60 R, 60 A, 60 B, 28, 58 F, 65 R, 65 EC, 58 R-58 EC, 58 E, 25, 26 R, DIG. 20

[56] References Cited

U.S. PATENT DOCUMENTS

| | | | |
|---|---|---|---|
| 2,219,074 | 10/1940 | Guillou | 273/58 F |
| 3,633,587 | 1/1972 | Hunt | 273/58 K |
| 4,194,737 | 3/1980 | Farmer | 273/65 R |
| 4,842,563 | 6/1989 | Russell | 273/58 H |
| 5,033,743 | 7/1991 | Wright | 273/58 K |

FOREIGN PATENT DOCUMENTS

| | | | |
|---|---|---|---|
| 2145630 | 3/1985 | United Kingdom | 273/60 R |

*Primary Examiner*—Paul E. Shapiro
*Assistant Examiner*—Steven B. Wong
*Attorney, Agent, or Firm*—Leon Gilden

[57] ABSTRACT

A ball game construction includes a spherical shell including a symmetrical path of openings directed through the shell to enhance deflection in a predictable manner in throwing of the ball. A modification of the invention includes raised seams in continuous communication between the openings, wherein the openings may alternatively be configured of a "C" shaped configuration. A modification of the invention includes a fluid bladder contained within the shell for selective filling of a semi-spherical portion of the shell for enhanced manipulation of the ball and deflection thereof in flight. Further, various plugs may be positioned within the openings, and wherein the seam portion may be formed as a hollow tube to receive various raised positions thereof.

1 Claim, 4 Drawing Sheets

GAME BALL CONSTRUCTION

BACKGROUND OF THE INVENTION

1. Field of the Invention

The field of invention relates to game ball apparatus, and more particularly pertains to a new and improved game ball construction wherein the same is arranged to provide for ease of manipulation of the game ball and its trajectory during use.

2. Description of the Prior Art

Game ball constructions of various types are utilized throughout the prior art utilizing various openings and the like to permit ease of deflection of the game ball in use. Such game ball apparatus is exemplified in the U.S. Pat. No. 4,438,924 to Carr wherein a game ball utilizes aerodynamically roughened surfaces in the nature of intersecting grooves to provide trajectory of the game ball in a deflecting manner.

U.S. Pat. No. 4,930,776 to Newcomb, et al. sets forth a game ball wherein a translucent plastic material is utilized formed with openings therethrough.

U.S. Pat. No. 4,616,827 to Bergland sets forth a playing ball utilizing opposed parabolic surfaces about a cylindrical equator.

Accordingly, it may be appreciated that there continues to be a need for a new and improved game ball construction as set forth by the instant invention which addresses both the problems of ease of use as well as effectiveness in construction in providing ease of manipulation of the game ball during its throwing and its trajectory.

SUMMARY OF THE INVENTION

In view of the foregoing disadvantages inherent in the known types of game ball apparatus now present in the prior art, the present invention provides a game ball construction wherein the same utilizes a symmetrical path of openings directed through the game ball. As such, the general purpose of the present invention, which will be described subsequently in greater detail, is to provide a new and improved game ball construction which has all the advantages of the prior art game ball apparatus and none of the disadvantages.

To attain this, the present invention provides a game ball construction including a spherical shell including a symmetrical path of openings directed through the shell to enhance deflection in a predictable manner in throwing of the ball. A modification of the invention includes raised seams in continuous communication between the openings, wherein the openings may alternatively be configured of a "C" shaped configuration. A modification of the invention includes a fluid bladder contained within the shell for selective filling of a semi-spherical portion of the shell for enhanced manipulation of the ball and deflection thereof in flight. Further, various plugs may be positioned within the openings, and wherein the seam portion may be formed as a hollow tube to receive various raised positions thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U S. Patent and Trademark Office and the public generally and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game ball construction which has all the advantages of the prior art game ball apparatus and none of the disadvantages.

It is another object of the present invention to provide a new and improved game ball construction which may be easily and efficiently manufactured and marketed.

It is a further object of the present invention to provide a new and improved game ball construction which is of a durable and reliable construction.

An even further object of the present invention is to provide a new and improved game ball construction which is susceptible of a low cost of manufacture with regard to both materials and labor, and which accordingly is then susceptible of low prices of sale to the consuming public, thereby making such game ball constructions economically available to the buying public.

Still yet another object of the present invention is to provide a new and improved game ball construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
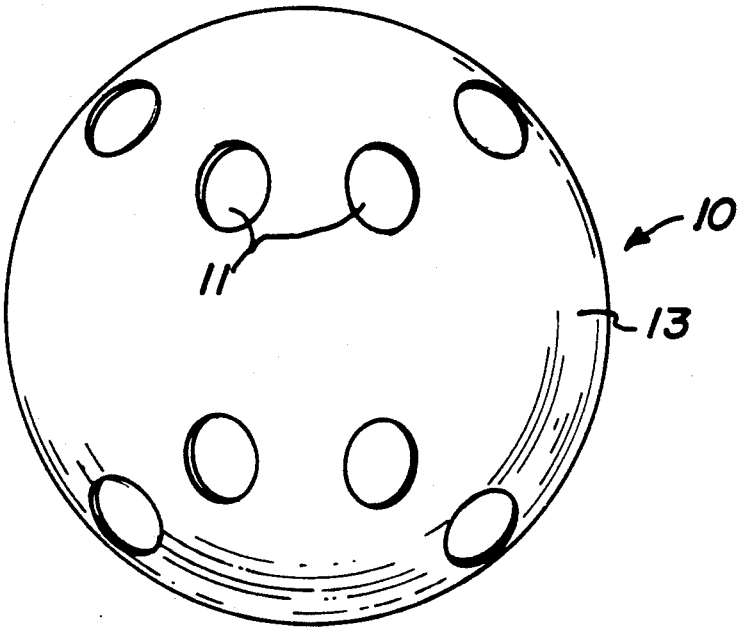
FIG. 1 is an orthographic view of the invention.

With reference now to the drawings, and in particular to FIGS. 1 to 10 thereof, a new and improved game ball construction embodying the principles and concepts of the present invention and generally designated by the reference numerals 10, 10*a*, and 10*b* will be described.

Figure 2:
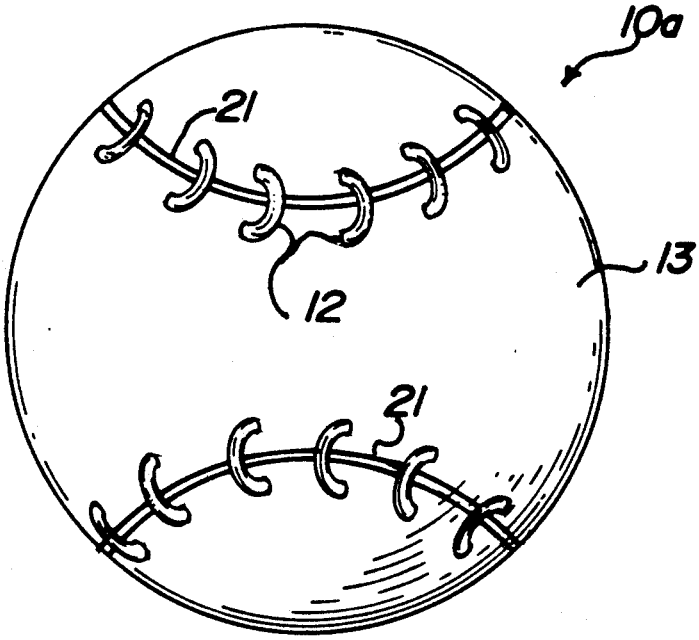
FIG. 2 is an orthographic view of a modification of the invention.
Figure 3:
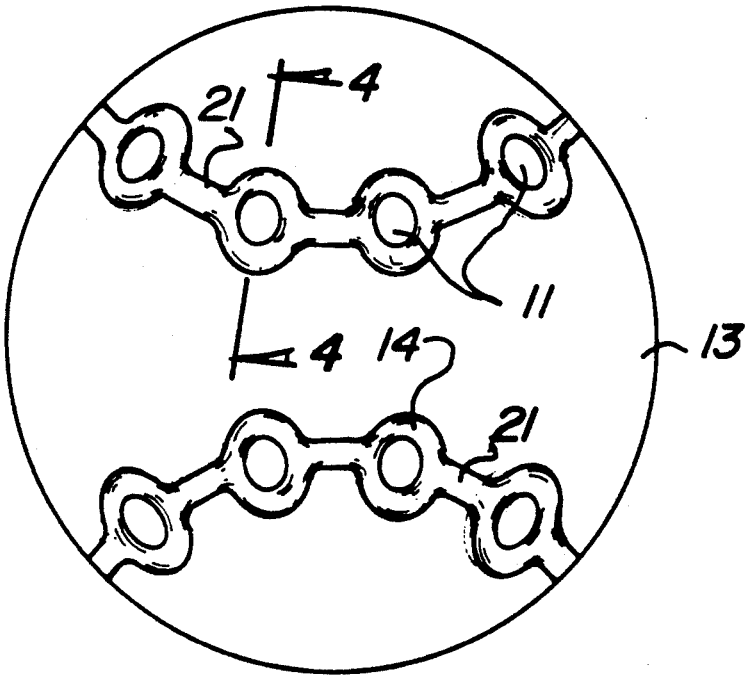
FIG. 3 is an orthographic view of the invention with the seam interconnecting the openings, as set forth in FIG. 1.
Figure 4:
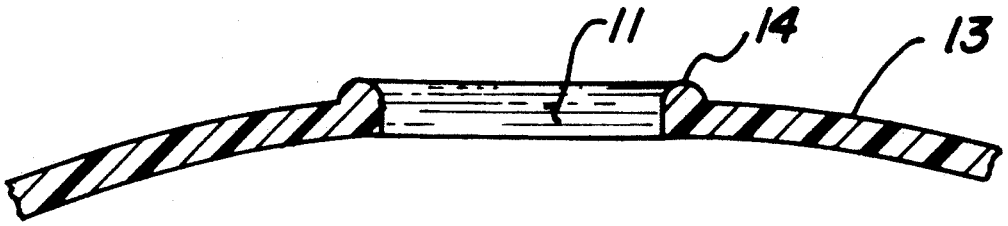
FIG. 4 is an orthographic view, taken along the lines 4—4 of FIG. 3 in the direction indicated by the arrows.

More specifically, the game ball construction 10 of the instant invention essentially comprises spheroidal projectile including a rigid smooth spheroidal shelf 13 including a continuous path of cylindrical openings 11, as illustrated in FIG. 1, or alternatively a continuous path of "C" shaped openings 12 that are arranged to more closely simulate the seams of a traditional baseball construction. As illustrated in FIG. 2, the "C" shaped openings 12 or alternatively the openings 11, as illustrated in FIG. 3, include an inner communicating seam 21. The seam defines a ridge that is raised within a range of one sixteenth to one eighth inch in height.

Further, the openings 11 may further be provided with a raised perimeter ridge 14 of a cylindrical configuration in surrounding relationship to each opening 11.

In the above construction, the balance of the ball is symmetrically displaced throughout the construction to permit ease of controlling the ball by an individual.

Figure 5:
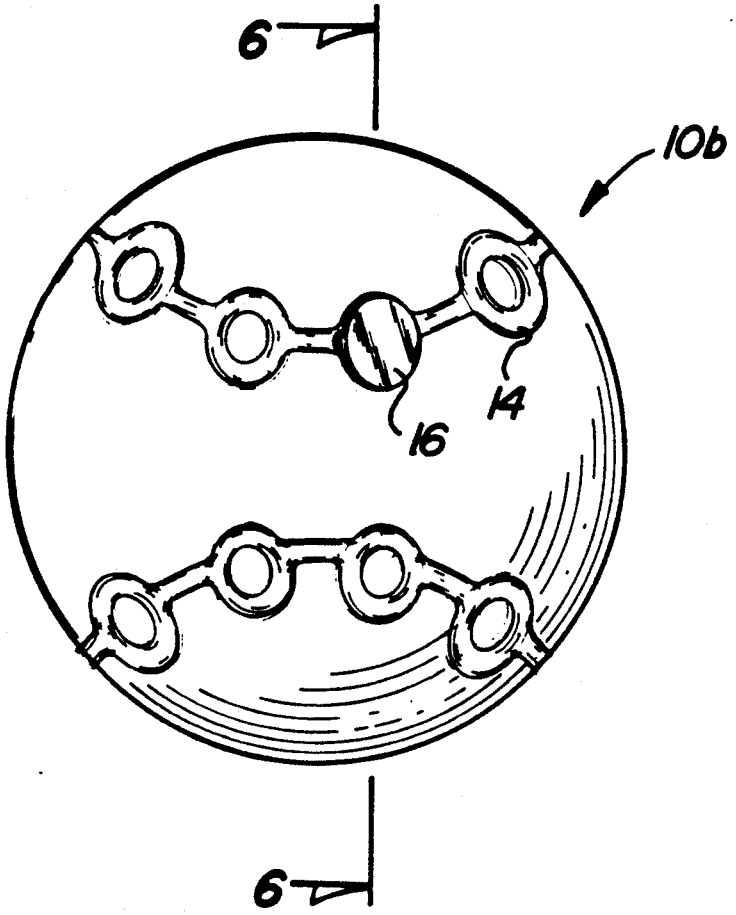
FIG. 5 is a further modification of the invention.
Figure 6:
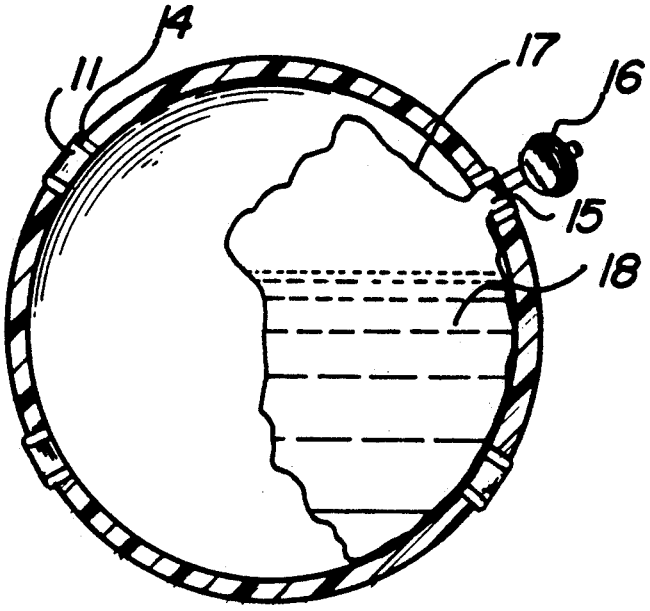
FIG. 6 is an orthographic view, taken along the lines 6—6 of FIG. 5 in the direction indicated by the arrows.
Figure 7:
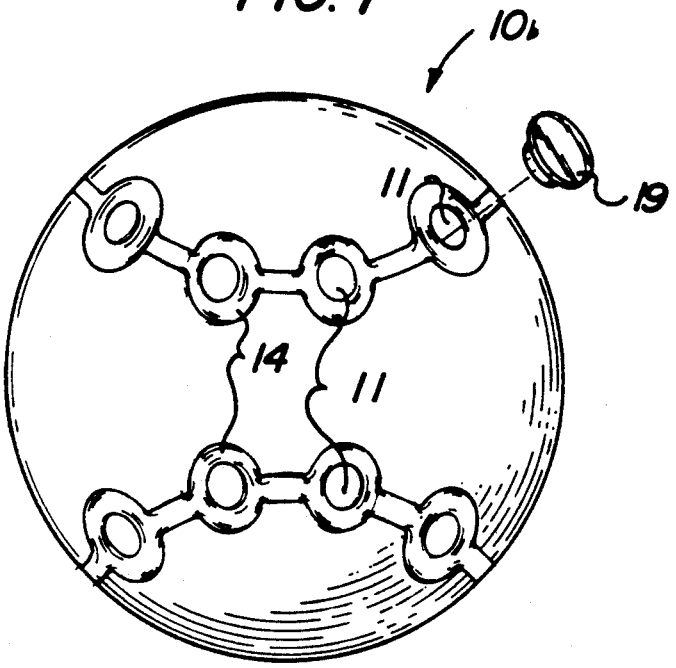
FIG. 7 is the invention of FIGS. 5 and 6 illustrating the use of cap members.
Figure 9:
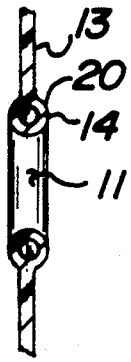
FIG. 9 is an orthographic view, taken along the lines 9—9 of FIG. 8 in the direction indicated by the arrows.
Figure 8:
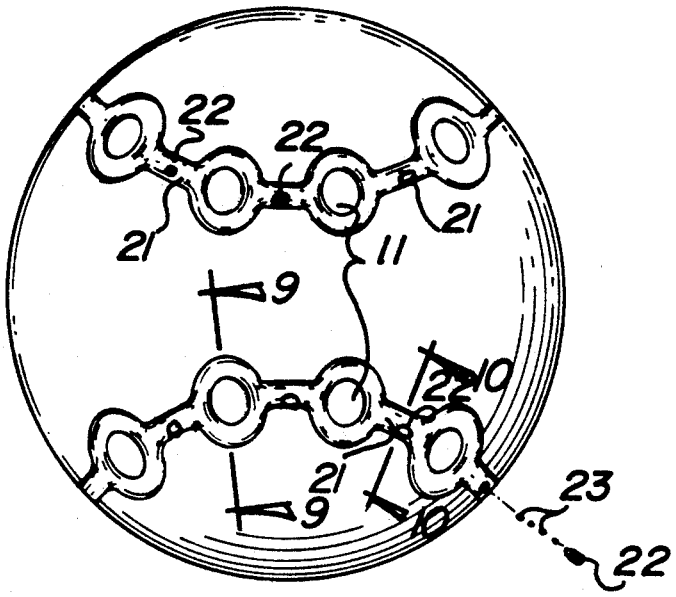
FIG. 8 is the invention further deploying hollow interconnecting seams.
Figure 10:
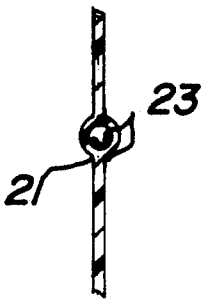
FIG. 10 is an orthographic view, taken along the lines 10—10 of FIG. 8 in the direction indicated by the arrows.

A modification of the invention, as exemplified in the FIG. 5, is arranged to include a fill opening 15, such as illustrated in FIG. 6, formed with a fill opening plug 16 pivotally mounted relative to the surrounding ridge 14, wherein the fill opening 15 is in fluid communication with a fluid impermeable bladder 17 positioned within a hemisphere of the ball construction. In this manner, a fluid 18 may be directed into the bladder to provide an imbalance therewithin to assist in the entertaining and enjoyment of the ball and its associated uncertain trajectory when thrown. Further, additionally the ball construction of the FIG. 6 may be arranged to include ferrous metallic caps 19 selectively received within selective ones of the openings 11, wherein the surrounding perimeter ridge 14 is formed to include a ferromagnetic ring 20 to assist in the magnetic attraction of the ferrous metallic caps 19. The selective positioning of the ferrous metallic caps may be provided to provide imbalance to the ball or the selective plugging of individual or all of the openings to permit a variation in utilization of the ball in its enjoyment and amusement. Further, the seams 21 may be formed of a hollow tubular construction, as illustrated in the FIG. 10, to receive selective spherical shot 23 therewithin, including seam plugs 22 directed into the seams to permit the selective filling of the seams with the shot. In this manner, variations in utilization of the organization may be employed to accommodate various game conditions and intentions of individuals utilizing the game ball construction of the instant invention.

Accordingly, it is believed the above description presents the invention in full and concise terms and accordingly no further description relative to the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A game ball construction, comprising, a spheroidal shell, including a continuous path of openings directed therethrough, the openings each include a raised perimeter ridge in surrounding relationship relative to each opening, and each ridge includes an inner communicating seam medially intersecting each perimeter ridge of each opening, and at least one of the openings defines a fill opening, a fill opening including an opening plug hingedly mounted to the fill opening, and the fill opening in fluid communication with a fluid impermeable bladder contained within the shell, the plug arranged for complementary reception within the opening, and at least one of the openings and a surrounding raised perimeter ridge includes a ferromagnetic ring, and further includes a ferrous metallic cap magnetically attracted to the ring and receivable within the at least one opening so as to create selective imbalance relative to the shell, and the inner communicating seams between adjacent raised perimeter ridges are each formed as a hollow tubular member, with a seam plug directed through the seam in communication with the hollow tubular member, and the hollow tubular member including a plurality of metallic spherical shot contained therewithin selectively removable from the tubular member to create selective imbalance relative to the shell.

* * * * *